US011293419B2

(12) United States Patent
Wang

(10) Patent No.: US 11,293,419 B2
(45) Date of Patent: Apr. 5, 2022

(54) AIR PUMP

(71) Applicant: BETO ENGINEERING AND MARKETING CO., LTD., Taichung (TW)

(72) Inventor: Lopin Wang, Taichung (TW)

(73) Assignee: BETO ENGINEERING AND MARKETING CO., LTD., Taiching (TW)

( * ) Notice: Subject to any disclaimer, the term of this patent is extended or adjusted under 35 U.S.C. 154(b) by 259 days.

(21) Appl. No.: 16/810,931

(22) Filed: Mar. 6, 2020

(65) Prior Publication Data

US 2020/0300233 A1 Sep. 24, 2020

(30) Foreign Application Priority Data

Mar. 20, 2019 (TW) ..... 108109623

(51) Int. Cl.

| | |
|---|---|
| ***F04B 33/00*** | (2006.01) |
| ***F04B 25/02*** | (2006.01) |
| ***F04B 39/00*** | (2006.01) |
| ***F04B 27/08*** | (2006.01) |

(52) U.S. Cl.

CPC ..... *F04B 33/005* (2013.01); *F04B 25/02* (2013.01); *F04B 39/0016* (2013.01); *F04B 27/0891* (2013.01)

(58) Field of Classification Search

CPC ..... F04B 33/00; F04B 33/005; F04B 25/02; F04B 39/0016; F04B 27/0891

See application file for complete search history.

(56) References Cited

U.S. PATENT DOCUMENTS 5,165,876 A * 11/1992 Wang ..... F04B 33/005 417/511
5,443,370 A * 8/1995 Wang ..... F04B 33/005 417/238
5,676,529 A * 10/1997 Hermansen ..... F04B 33/005 417/259

(Continued)

FOREIGN PATENT DOCUMENTS

TW 263020 U 11/1995
TW 382410 U 2/2000

(Continued)

OTHER PUBLICATIONS

Search Report appended to an Office Action, which was issued to Taiwanese counterpart application No. 108109623 by the TIPO dated Jul. 2, 2020, with an English translation thereof.

*Primary Examiner* — Nathan C Zollinger

(57) ABSTRACT

An air pump includes a mouthpiece, an adjustment mechanism, and an air cylinder mechanism that includes a small-diameter cylinder permitted to move relative to the adjustment mechanism. When the small-diameter cylinder is moved away from the adjustment mechanism, air from external environment is sucked into a first space of the air cylinder mechanism. The adjustment mechanism is operable to switch between a singular pumping state, where air in the first space is released to the external environment when the small-diameter cylinder is moved toward the adjustment mechanism, and a dual pumping state, where the air in the first space is injected into the mouthpiece when the small-diameter cylinder is moved toward the adjustment mechanism.

9 Claims, 9 Drawing Sheets

(56) References Cited

U.S. PATENT DOCUMENTS

| | | | | | |
|---|---|---|---|---|---|
| 5,997,256 | A * | 12/1999 | Gunther | F04B 25/02 | 417/259 |
| 6,027,319 | A * | 2/2000 | Winefordner | F04B 33/005 | 417/440 |
| 6,065,947 | A * | 5/2000 | Wu | F04B 25/02 | 417/526 |
| 6,190,142 | B1 * | 2/2001 | Wu | F04B 33/005 | 417/259 |
| 6,371,741 | B1 * | 4/2002 | Wu | F04B 19/02 | 417/446 |
| 7,353,746 | B2 * | 4/2008 | Kutella | F04B 49/18 | 92/61 |
| 8,936,446 | B2 * | 1/2015 | Wang | F04B 33/00 | 417/437 |
| 8,944,782 | B2 * | 2/2015 | Chuang | F04B 33/005 | 417/374 |
| 10,815,981 | B2 * | 10/2020 | Wu | F04B 39/14 | |
| 11,125,221 | B2 * | 9/2021 | Wang | F04B 33/00 | |
| 2009/0104059 | A1 * | 4/2009 | Wang | F04B 19/022 | 417/468 |
| 2017/0167477 | A1 * | 6/2017 | Hermansen | F04B 33/005 | |
| 2020/0300233 | A1 * | 9/2020 | Wang | F04B 25/02 | |
| 2021/0364013 | A1 * | 11/2021 | Wu | F04B 25/02 | |

FOREIGN PATENT DOCUMENTS

| | | | |
|---|---|---|---|
| TW | 524274 | U | 3/2003 |
| TW | M329108 | U | 3/2008 |
| TW | 201500643 | A | 1/2015 |

* cited by examiner

AIR PUMP

CROSS-REFERENCE TO RELATED APPLICATION

This application claims priority of Taiwanese Patent Application No. 108109623, filed on Mar. 20, 2019.

FIELD

The disclosure relates to an air pump, and more particularly to a manual air pump.

BACKGROUND

A manual miniature air pump is inconvenient for a user to operate due to its compact nature, as the user has to exert force with one hand to operate the air pumping mechanism of the air pump, while the other hand is used to keep the air pump stationary. A conventional manual air pump, such as the one disclosed in Chinese Patent No. 101737294, includes an inner tube that has a front end fixedly mounted to a mouthpiece, and an outer tube that is axially movable relative to the inner tube for pumping air.

A pumping cycle is performed when the outer tube is driven to move forwardly relative to the inner tube such that it thoroughly sleeves the inner tube while it pumps the air through the mouthpiece, and then outer tube is moved away from the inner tube so that it merely sleeves a rear end of the inner tube while it sucks air therein. However, in practice, as the user has to hold the inner tube in place with one hand, the hand would easily obstruct the path the outer tube travels during the pumping cycle. To avoid self-injury, the user tends to move the outer tube forwardly to only partially sleeve the inner tube, so as to avoid being hit by the outer tube. As a result, each iteration of the pumping cycle tends to be incomplete, thereby less effective.

In addition, the abovementioned conventional manual air pump only permits one high-pressure pumping mode, which is undesirable for pumping un-pumped subject that is more preferable to be pumped with air of low pressure and in high volume.

SUMMARY

Therefore, an object of the disclosure is to provide an air pump that can alleviate at least one of the drawbacks of the prior art.

According to the disclosure, the air pump includes a mouthpiece, an adjustment mechanism fixedly mounted to the mouthpiece, and an air cylinder mechanism. The adjustment mechanism is operable to switch between a singular pumping state and a dual pumping state. The air cylinder mechanism includes a connecting tube, a small-diameter cylinder, a large-diameter cylinder, an end plug, a unidirectional intake plug, a piston, a unidirectional communication plug, and a rear check valve set.

The connecting tube extends axially in a front-rear direction and has a front end that is fixedly connected to the adjustment mechanism and that is in fluid communication with the mouthpiece. The small-diameter cylinder extends axially and sleeves around the connecting tube. The large-diameter cylinder extends axially, sleeves around the small-diameter cylinder and has a front end that is fixedly connected to the adjustment mechanism. The end plug seals a rear end of the small-diameter cylinder. The intake plug is fixedly mounted to a rear end of the large-diameter cylinder and sleevedly abuts against an outer surrounding surface of the small-diameter cylinder. The piston is fixedly mounted to a front end of the small-diameter cylinder and airtightly abuts against an inner surrounding surface of the large-diameter cylinder and an outer surrounding surface of the connecting tube. The communication plug is fixedly mounted to a rear end of the connecting tube, is fluidly communicated to the connecting tube, and abuts against an inner surrounding surface of the small-diameter cylinder. The rear check valve set is mounted between the connecting tube and the communication plug.

The piston and the adjustment mechanism cooperatively define a first space therebetween, the piston and the intake plug cooperatively define a second space therebetween, the communication plug and the piston cooperatively define a third space therebetween that is in fluid communication with the second space, and the communication plug and the end plug cooperatively define a fourth space therebetween.

When the small-diameter cylinder is moved away from the adjustment mechanism, air from external environment is sucked into the first space via the adjustment mechanism, and air in the second space and the third space is pushed to flow into the fourth space via the communication plug. When the small-diameter cylinder is moved toward the adjustment mechanism, the intake plug and the rear check valve set are open, such that the air from the external environment is sucked into the second space via the intake plug, and air in the fourth space is injected into the mouthpiece sequentially via the rear check valve set and the connecting tube.

When the adjustment mechanism is in the singular pumping state, air in the first space is released to the external environment during the movement of the small-diameter cylinder toward the adjustment mechanism. When the adjustment mechanism is in the dual pumping state, air in the first space is injected into the mouthpiece during the movement of the small-diameter cylinder toward the adjustment mechanism.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
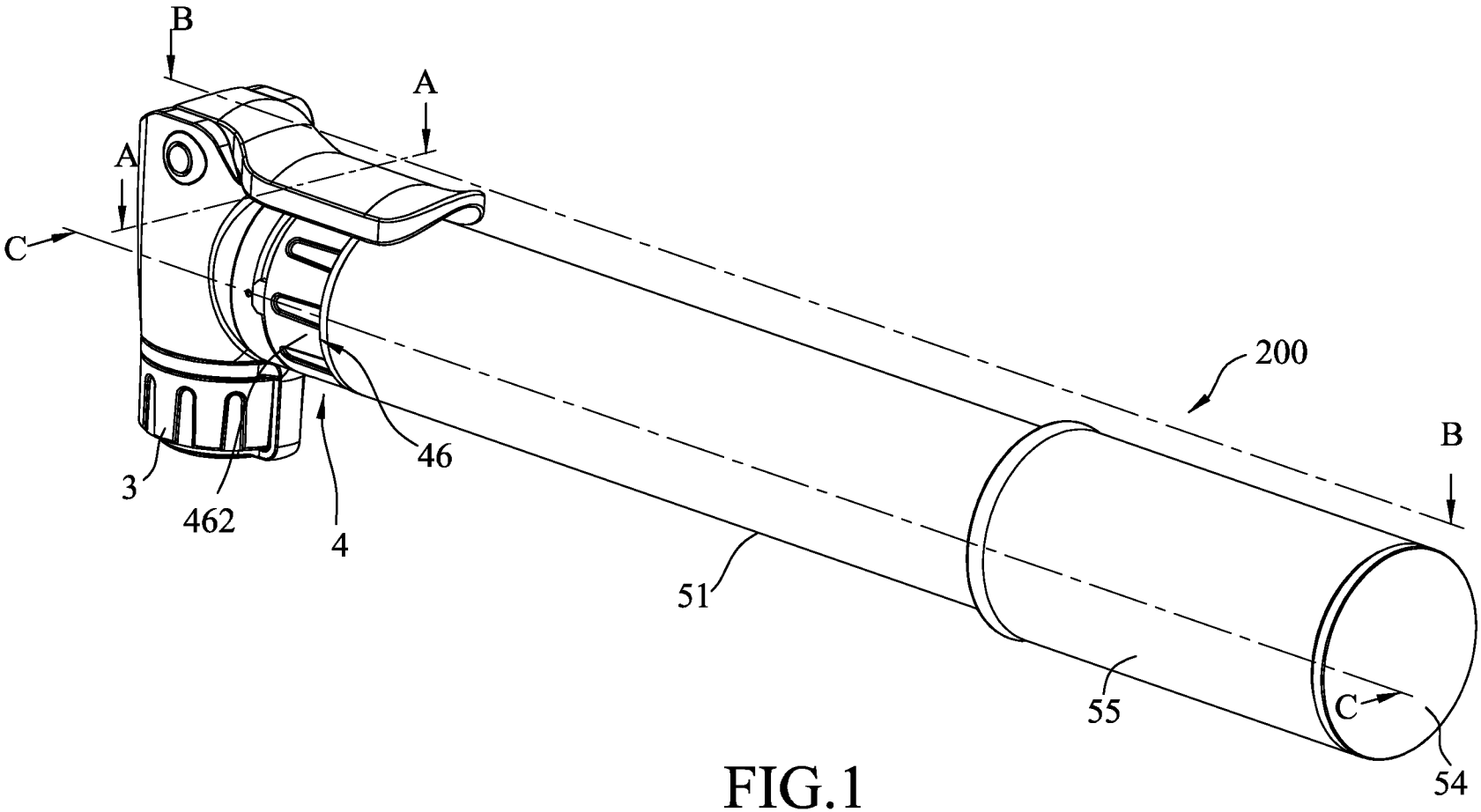
FIG. 1 is a perspective view of an embodiment of an air pump according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
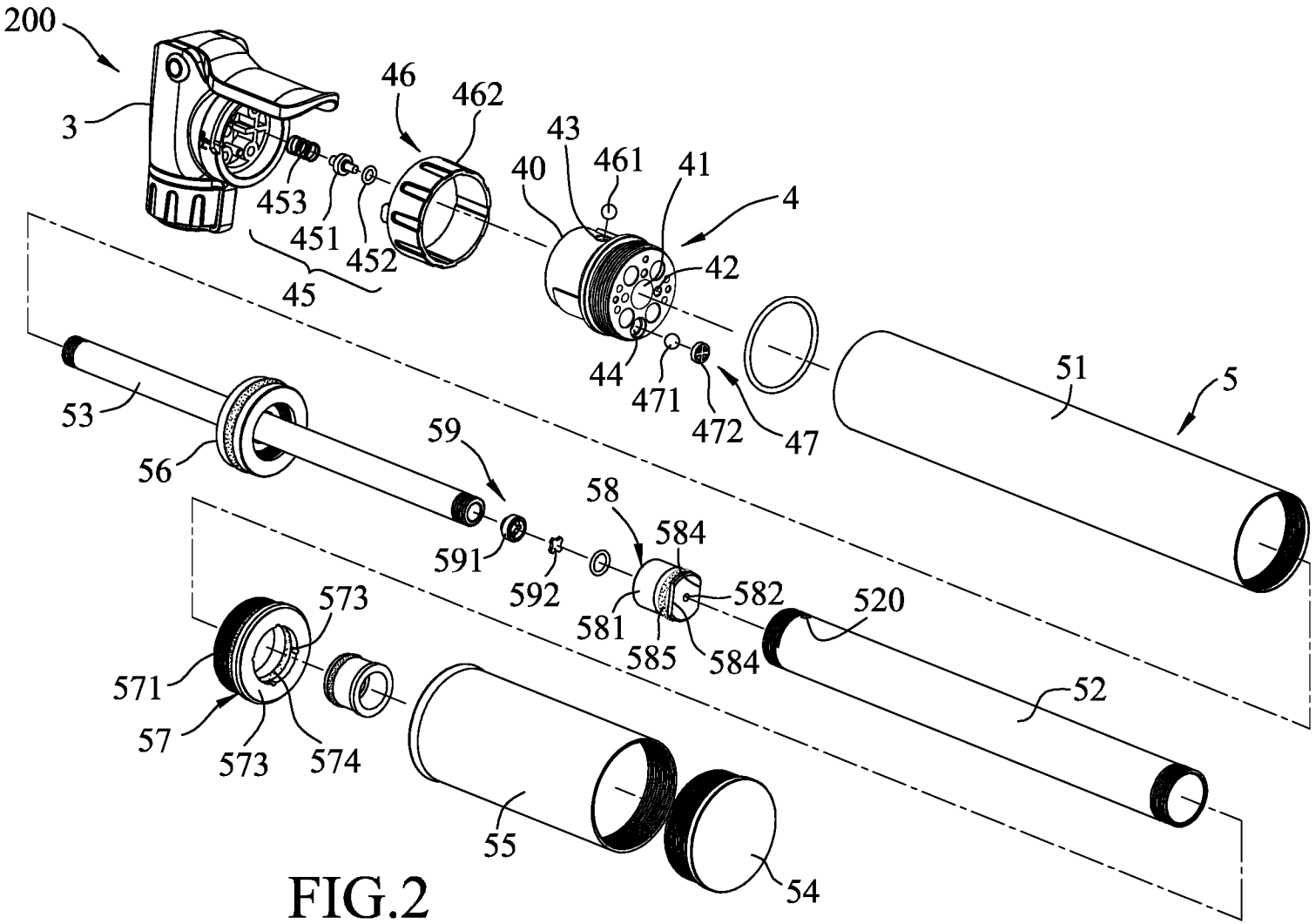
FIG. 2 is an exploded perspective view of the embodiment.
Figure 3:
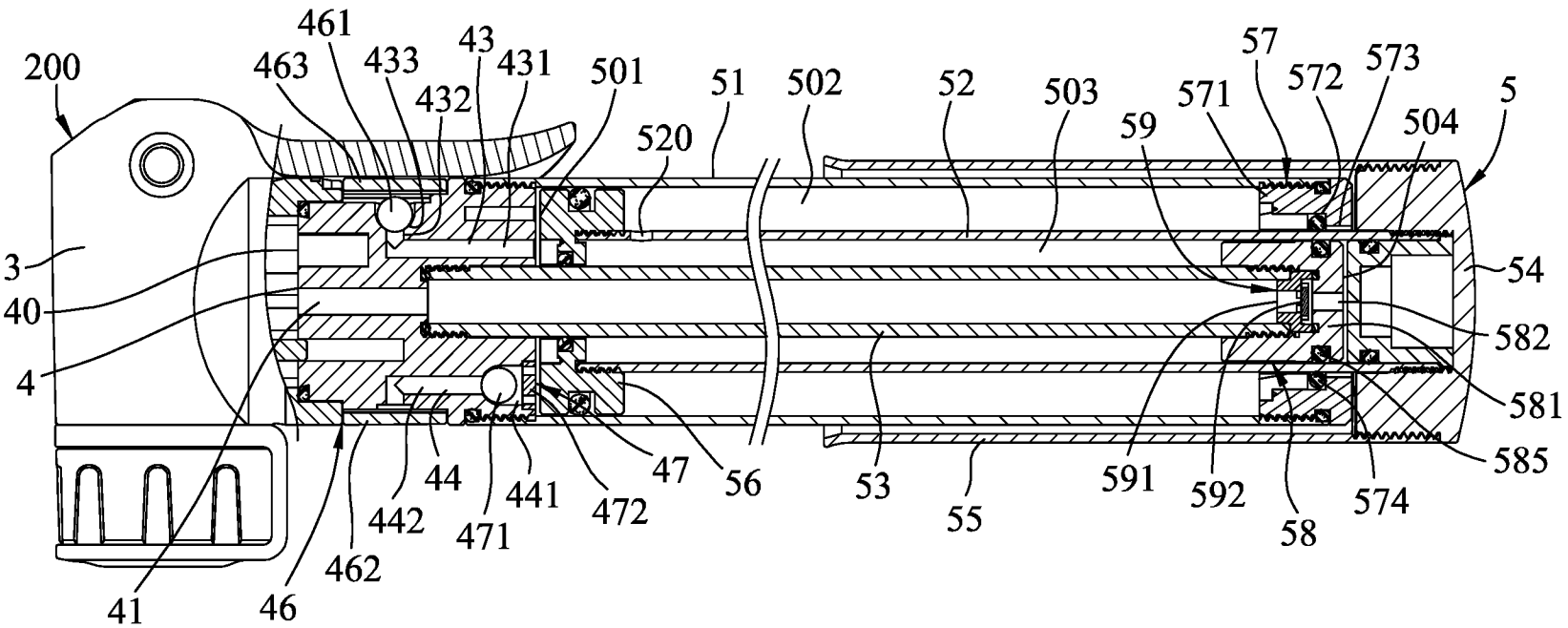
FIG. 3 is a fragmentary sectional view of the embodiment.
Figure 5:
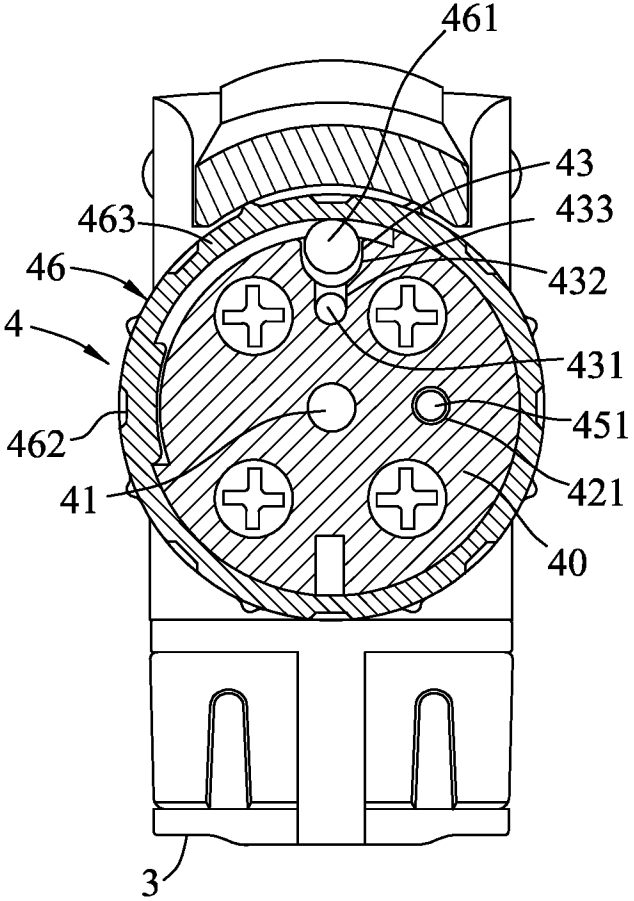
FIG. 5 is a view similar to FIG. 4, illustrating the air exhaust switch in an open position.

Referring to FIGS. 1 to 3, an embodiment of an air pump 200 according to the disclosure is adapted for performing an air pumping process to an inflatable object (not shown), such as tires or balls. The air pump 200 includes a mouthpiece 3, an adjustment mechanism 4 fixedly mounted to the mouthpiece 3, and an air cylinder mechanism 5 that extends axially in a front-rear direction and that has a front end fixedly connected to the adjustment mechanism 4. The mouthpiece 3 is adapted to be installed onto the inflatable object for transporting air thereinto. In addition, the mouthpiece 3 may come in different forms or shapes, and is not restricted to the one shown in the embodiment. The adjustment mechanism 4 is operable to switch between a singular pumping state and a dual pumping state, and includes an adjustment seat 40 that is fixedly mounted between the mouthpiece 3 and the air cylinder mechanism 5, and a front check valve set 45, an air exhaust switch 46 and a unidirectional intake valve set 47 that are all mounted to the adjustment seat 40. The above-mentioned elements will be described in further details after the following paragraphs.

Figure 6:
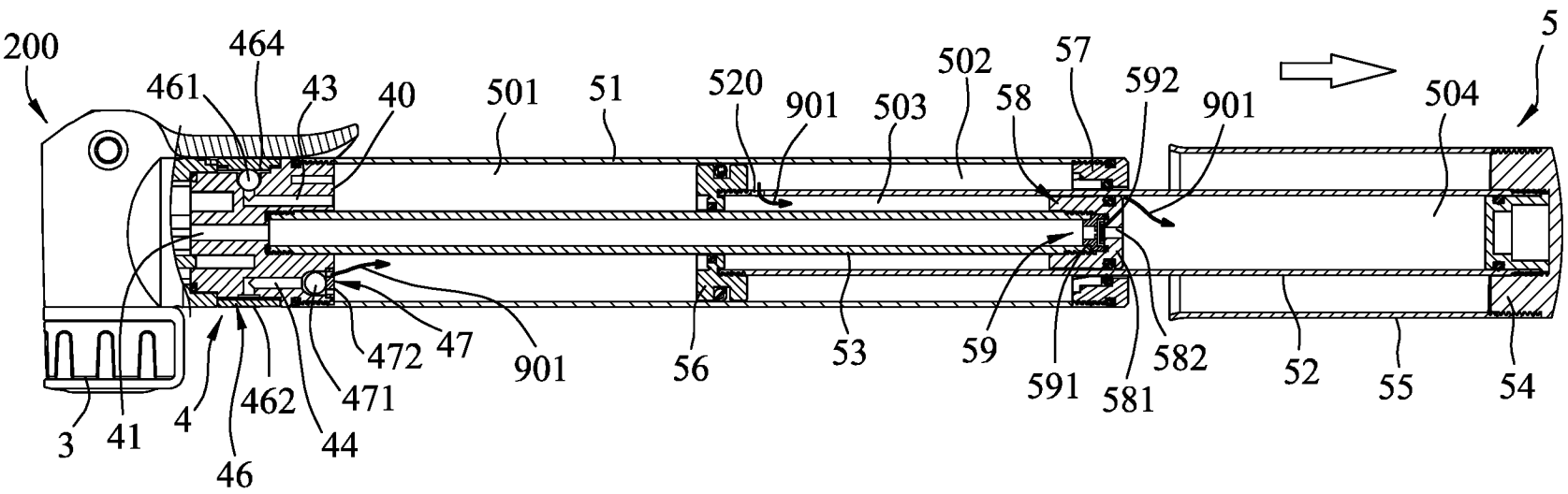
FIG. 6 is a sectional view taken along line B-B in FIG. 1, illustrating a handle tube of an air cylinder mechanism of the embodiment being moved rearwardly relative to a large-diameter cylinder of the air cylinder mechanism.

Referring to FIGS. 2, 3 and 6, the air cylinder mechanism 5 includes a large-diameter cylinder 51, a small-diameter cylinder 52, a connecting tube 53, an end plug 54, a handle tube 55, a unidirectional intake plug 57, a piston 56, a unidirectional communication plug 58, and a rear check valve set 59. The connecting tube 53 extends axially and has a front end that is fixedly connected to the adjustment seat 40 of the adjustment mechanism 4 and that is in fluid communication with the mouthpiece 3. The small-diameter cylinder 52 extends axially and sleeves around the connecting tube 53. The large-diameter cylinder 51 extends axially, sleeves around the small-diameter cylinder 52, and has a front end fixedly connected to the adjustment seat 40 of the adjustment mechanism 4. The end plug 54 is fixedly mounted to and seals a rear end of the small-diameter cylinder 52. The handle tube 55 is fixedly mounted to the end plug 54 and is permitted to move relative to the large-diameter cylinder 51 to sleeve therearound. The intake plug 57 is fixedly mounted to a rear end of the large-diameter cylinder 51 and sleevedly abuts against an outer surrounding surface of the small-diameter cylinder 52. The piston 56 is fixedly mounted to a front end of the small-diameter cylinder 52 and airtightly abuts against an inner surrounding surface of the large-diameter cylinder 51 and an outer surrounding surface of the connecting tube 53. The communication plug 58 is fixedly mounted to a rear end of the connecting tube 53, is fluidly communicated to the connecting tube 53, and abuts against an inner surrounding surface of the small-diameter cylinder 52. The rear check valve set 59 is mounted between the connecting tube 53 and the communication plug 58.

The piston 56 and the adjustment mechanism 4 cooperatively define a first space 501 therebetween, the piston 56 and the intake plug 57 cooperatively define a second space 502, the communication plug 58 and the piston 56 cooperatively define a third space 503 therebetween, and the communication plug 58 and the end plug 54 cooperatively define a fourth space 504 therebetween. The small-diameter cylinder 52 is formed with a through hole 520 that extends radially therethrough and that fluidly communicates the second space 502 to the third space 503.

Figure 7:
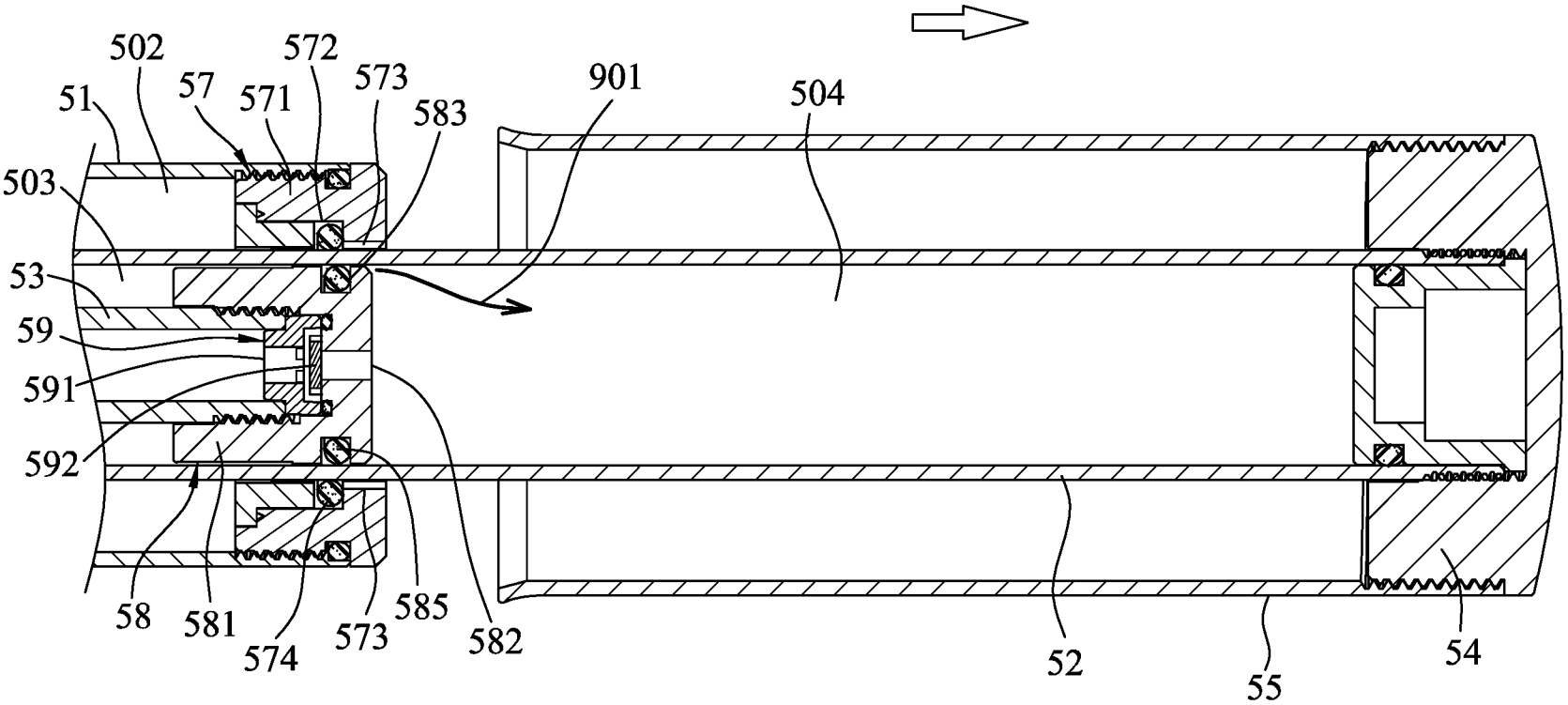
FIG. 7 is an enlarged fragmentary view of FIG. 6.
Figure 10:
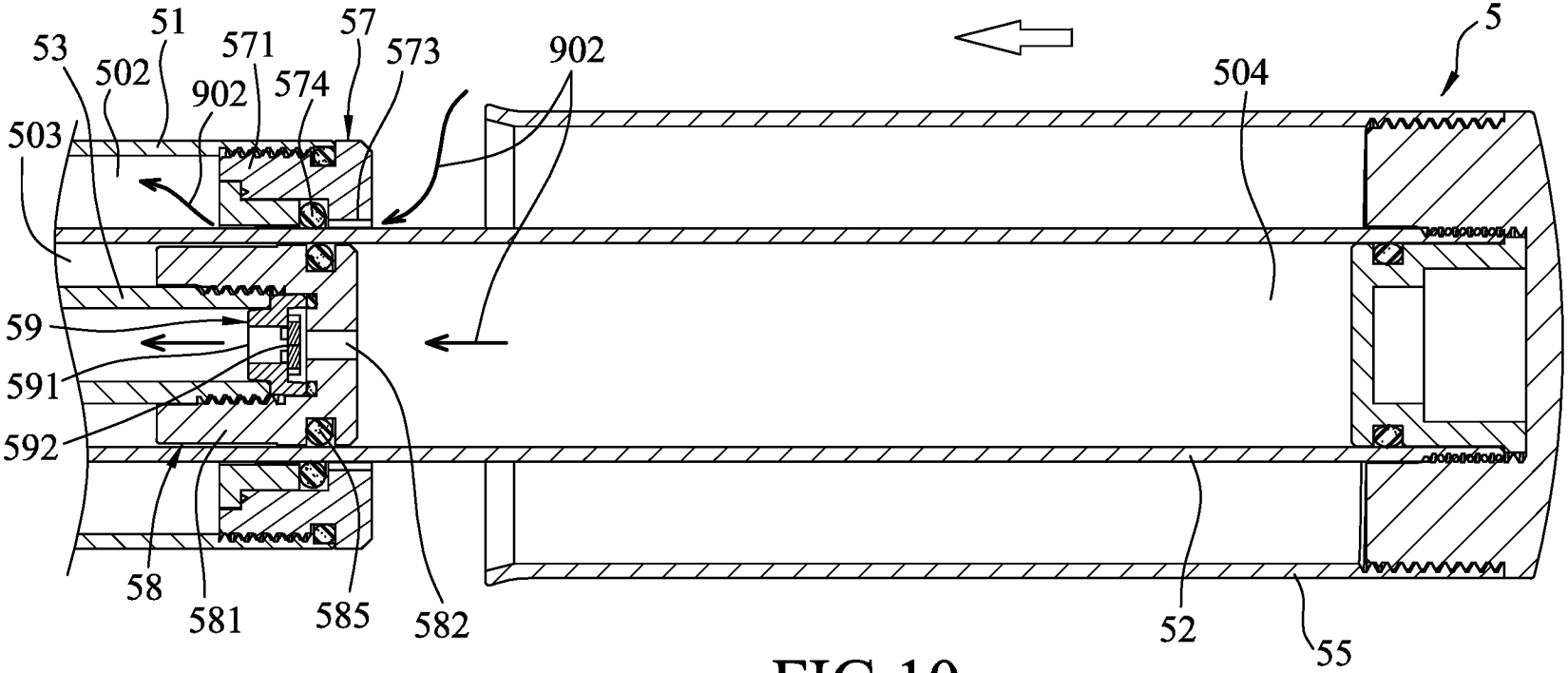
FIG. 10 is an enlarged fragmentary view of FIG. 9.

Referring to FIGS. 2, 7 and 10, the intake plug 57 is permitted to unidirectionally and fluidly communicate the second space 502 to external environment, and includes an end block 571 that is fixedly mounted to the rear end of the large-diameter cylinder 51 and that sleeves around the small-diameter cylinder 52, and a plug gasket 574 that is movably mounted to an inner surface of the end block 571 and that airtightly abut against the small-diameter cylinder 52. The inner surface of the end block 571 is indented with an inner annular groove 572 that is for the plug gasket 574 to be movably mounted thereto, and a plurality of intake pathways 573 that are angularly spaced apart and that axially and fluidly communicate the inner annular groove 572 to the external environment. In addition, the end block 571 is formed with a connecting pathway (not shown) that fluidly communicates the second space 502 to the inner annular groove 572.

Referring specifically to FIG. 7, when the intake plug 57 moves forwardly relative to the small-diameter cylinder 52, due to friction formed between the plug gasket 574 and the outer surrounding surface of the small-diameter cylinder 52, the plug gasket 574 is driven to move rearwardly, sealing the intake pathways 573 as a result. As such, the second space 502 is airtightly sealed from the external environment. However, referring specifically to FIG. 10, when the intake plug 57 moves rearwardly relative to the small-diameter cylinder 52, the plug gasket 574 is driven to move forwardly instead, unsealing the intake pathways 573 so that the second space 502 is fluidly communicated to the external environment via the inner annular groove 572 and the intake pathways 573. As there are other designs of the intake plug 57 that also permits unidirectional air flow from the second space 502 to the external environment, the intake plug 57 implemented in other embodiments may vary, and is not restricted to the design disclosed herein.

The communication plug 58 includes a plug body 581 that is fixedly mounted to the rear end of the connecting tube 53 and that has an axial hole 582 axially and fluidly communicating the connecting tube 53 and the fourth space 504 of the air cylinder mechanism 5, and a piston gasket 585 that is axially movable, that sleeves around the plug body 581 and that airtightly abuts against the inner surrounding surface of the small-diameter cylinder 52. The plug body 581 has an outer annular groove 583 (see FIG. 7) that indents from an outer surface of the plug body 581 and that is for the piston gasket 585 to sleeve thereto, and two cutoff openings 584 (see FIG. 2) that axially and fluidly communicates the outer annular groove 583 and the fourth space 504.

Referring specifically to FIG. 7, when the plug body 581 of the communication plug 58 moves forwardly relative to the small-diameter cylinder 52, due to friction formed between the piston gasket 585 and the inner surrounding surface of the small-diameter cylinder 52, the piston gasket 585 is driven to move rearwardly to unseal free flow through the cutoff openings 584 (see FIG. 2) so that the third space 503 is fluidly communicated to the fourth space 504. On the other hand, referring specifically to FIG. 10, when the plug body 581 of the communication plug 58 moves rearwardly relative to the small-diameter cylinder 52, the piston gasket 585 is driven to move forwardly to seal a gap between the plug body 581 and the small-diameter cylinder 52, essentially sealing the free flow between the third space 503 and the fourth space 504 via the cutoff openings 584. As there are other designs of the communication plug 58 that also permits unidirectional air flow from the third space 503 to the fourth space 504, the communication plug 58 implemented in other embodiments may vary, and is not restricted to the design disclosed herein.

The rear check valve set 59 has an annular valve seat 591 that fluidly communicates the connecting tube 53 to the axial hole 582, and a check valve member 592 that is mounted to the valve seat 591 and that is permitted to be driven by air pressure of the fourth space 504 to openably seal free flow between the connecting tube 53 and the fourth space 504 via the axial hole 582.

Referring to FIGS. 3, 4, 5, and 9, the adjustment seat 40 of the adjustment mechanism 4 has a first pumping hole 41 fluidly communicating the mouthpiece 3 to the connecting tube 53 of the air cylinder mechanism 5, a second pumping hole 42 fluidly communicating the mouthpiece 3 to the first space 501 in the air cylinder mechanism 5, an exhaust hole 43 fluidly communicating the first space 501 to the external environment, and an intake hole 44 fluidly communicating the external environment to the first space 501.

The first and second pumping holes 41, 42 are permitted for guiding air from the air cylinder mechanism 5 into the mouthpiece 3. The second pumping hole 42 has a small-diameter pumping section 421 that extends axially and that is fluidly communicated to the first space 501, and a large-diameter pumping section 422 that fluidly communicates the small-diameter pumping section 421 to the mouthpiece 3 and that has a diameter larger than that of the small-diameter pumping section 421. The exhaust hole 43 has a connecting section 431 that extends axially and that is fluidly communicated to the first space 501, a small-diameter exhaust section 432 that extends radially and that is fluidly communicated to the connecting section 431, and a large-diameter exhaust section 433 that is coaxial with the small-diameter exhaust section 432 and that fluidly communicates the small-diameter exhaust section 432 to the external environment and that has a diameter larger than that of the small-diameter exhaust section 432. The intake hole 44 has an outer connecting section 442 that is fluidly communicated to the external environment, and an inner connecting section 441 that extends axially and fluidly communicates the outer connecting section 442 to the first space 501 and that has a diameter larger than that of the outer connecting section 442.

The front check valve set 45 of the adjustment mechanism 4 is permitted to be driven by air pressure of the first space 501 to openably and unidirectionally seal the second pumping hole 42, and includes a check valve body 451 that is mounted in the large-diameter pumping section 422 of the second pumping hole 42 and that is inserted into the small-diameter pumping section 421 of the second pumping hole 42, a valve gasket 452 that sleeves around the check valve body 451, and a resilient member 453 that is mounted to the large-diameter pumping section 422 and that resiliently biases the check valve body 451 toward the small-diameter pumping section 421 to cooperate with the valve gasket 452 for sealing the small-diameter pumping section 421.

Figure 4:
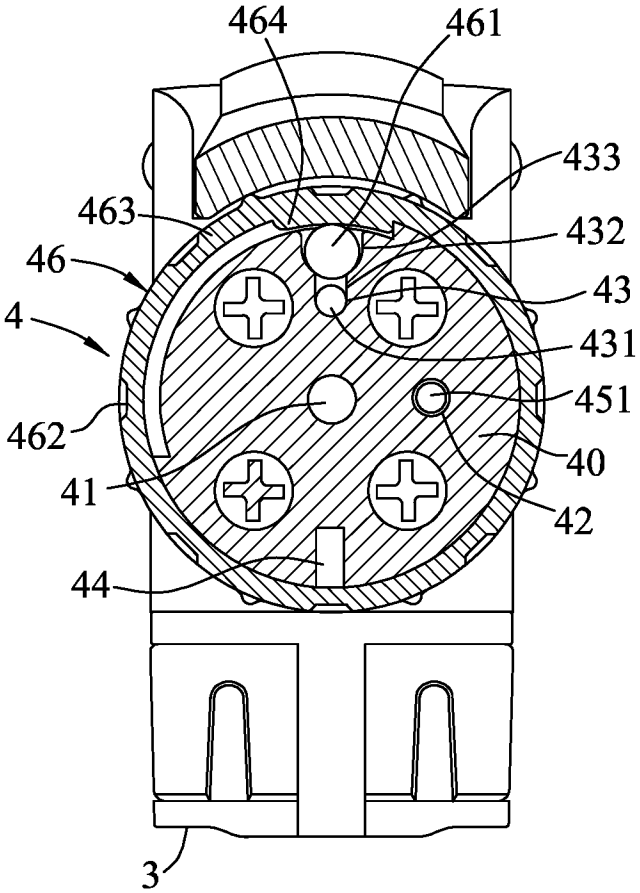
FIG. 4 is a sectional view taken along line A-A in FIG. 1, illustrating an air exhaust switch of an adjustment mechanism of the embodiment in a closed position.

The air exhaust switch 46 of the adjustment mechanism 4 is operable to openably seal the exhaust hole 43, and has a sealing member 461 that is mounted in the large-diameter exhaust section 433 of the exhaust hole 43 and that is permitted to seal opening of the small-diameter exhaust section 432 of the exhaust hole 43 to the external environment, and an adjustment member 462 that is mounted to the adjustment seat 40. The adjustment member 462 has an annular portion 463 that is operable to rotatably sleeve around the adjustment seat 40 and to cover the exhaust hole 43, and an abutting portion 464 that protrudes radially from an inner surface of the annular portion 463 and that is driven by the annular portion 463 to removably and radially push the sealing member 461. The adjustment member 462 is operable to rotate relative to the adjustment seat 40 between a sealed position (as shown in FIG. 4), where the abutting portion 464 thereof radially and inwardly push the sealing member 461, and an open position, where the abutting portion 464 thereof is separated from the sealing member 461.

To switch the adjustment mechanism 4 to the dual pumping state, the adjustment member 462 is rotated into the sealed position (see FIG. 4) to push the sealing member 461 to airtightly seal the small-diameter exhaust section 432 of the exhaust hole 43. As a result, the front check valve set 45 is permitted to be driven by the air pressure of the first space 501 to open, so that both the first and second pumping holes 41, 42 are permitted to guide the air respectively from the connecting tube 53 and the first space 501 of the air cylinder mechanism 5 into the mouthpiece 3.

To switch the adjustment mechanism. 4 to the singular pumping state, the adjustment member 462 is rotated into the open position (see FIG. 5), so that the sealing member 461 is permitted to be driven by air pressure in the small-diameter exhaust section 432 to move radially and outwardly, such that the exhaust hole 43 is permitted to release the air of the first space 501 into the external environment. As a result, the front check valve set 45 would not be driven by the air pressure of the first space 501 to open, such that the second pumping hole 42 remains sealed, and that only the first pumping hole 41 is permitted to guide the air from the connecting tube 53 of the air cylinder mechanism 5 into the mouthpiece 3.

The intake valve set 47 includes a valve member 471 that is movably mounted in the inner connecting section 441 of the intake hole 44, and a blocking member 472 that communicates the inner connecting section 441 to the first space 501, that is mounted to the adjustment seat 40, and that retains position of the valve member 471 relative to the inner connecting section 441. The valve member 471 is permitted to be driven by the air pressure of the first space 501 to seal the outer connecting section 442 of the intake hole 44, and is permitted to be driven by negative pressure of the first space 501 to unseal the intake hole 44 to fluidly communicate the external environment with the first space 501.

During the use of the air pump 200, after the mouthpiece 3 is mounted to an inflatable object (not shown), a user is permitted to operate the adjustment member 462 of the air exhaust switch 46 to switch the adjustment mechanism 4 between the singular pumping state and the dual pumping state. Then, after the user holds onto a front end portion of the large-diameter cylinder 51 of the air cylinder mechanism 5 with one hand and the handle tube 55 of the air cylinder mechanism 5 with the other hand, the user is able to perform pumping process of the air pump 200 by cyclically pulling and pushing the handle tube 55 relative to the large-diameter cylinder 51 in the front-rear direction.

Referring back to FIGS. 6 and 7, when the handle tube 55 is pulled rearwardly relative to the large-diameter cylinder 51, the piston 56 is driven alongside the small-diameter cylinder 52 to move rearwardly relative to the large-diameter cylinder 51 as well. Meanwhile, the intake plug 57 and the communication plug 58 are moved forwardly relative to the small-diameter cylinder 52, such that the intake plug 57 is sealed and the communication is open. During this "pulling" process, the first space 501 and the fourth space 504 expand in volume, and the second space 502 and the third space 503 shrink in volume. Air in the second space 502 and the third space 503 is pushed to flow into the fourth space 504 via the communication plug 58 along the first airflow pathway 901. The expansion of the first space 501 generates the negative pressure that drives the intake valve set 47 of the adjustment mechanism 4 to be open, and air from the external environment is sucked into the first space 501 via the intake hole 44 of the adjustment mechanism 4 to flow along a first airflow pathway 901.

During this time (i.e., during the pulling process), if the air pressure in the fourth space 504 is smaller than that of the connecting tube 53, the rear check valve set 59 would be sealed, permitting the air pressure in the fourth space 504 to build up. Conversely, if the air pressure in the fourth space 504 is higher than that of the connecting tube 53, the rear check valve set 59 would be driven by the air pressure of the fourth space 504 to open, such that the air in the fourth space 504 is guided by the connecting tube 53 to be fluidly communicated to the mouthpiece 3 for pumping the inflatable object.

When the piston 56 is restrained from moving rearwardly alongside the small-diameter cylinder 52 any further by the intake plug 57, the air pump 200 is at its maximum extended state. Then, the small-diameter cylinder 52 is pushed alongside the handle tube 55 forwardly relative to the large-diameter 51 to return to its original position, where the piston 56 is in contact with the adjustment mechanism 4 (see FIG. 3).

Figure 8:
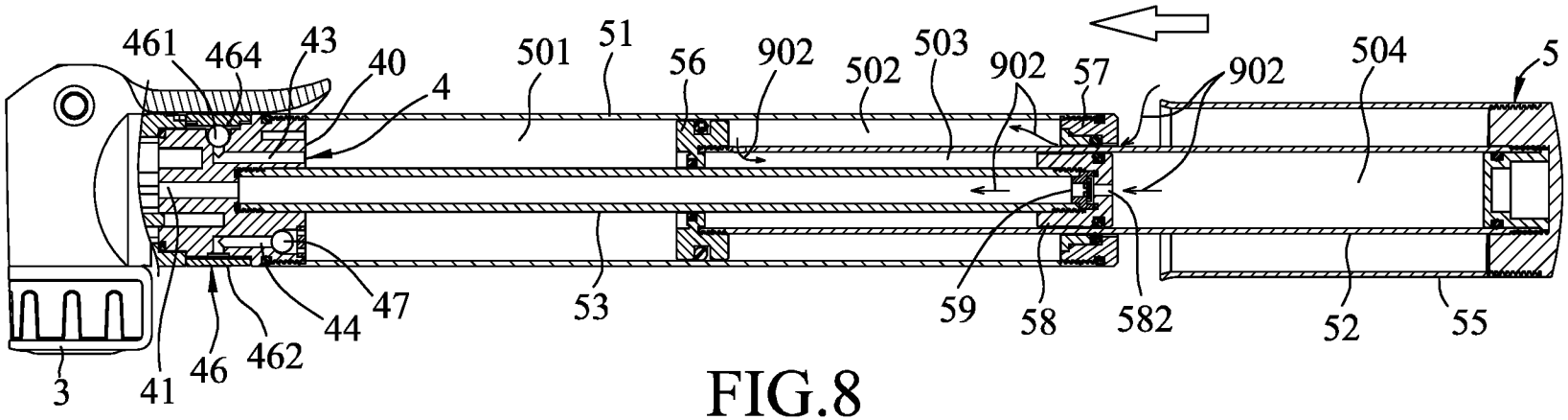
FIG. 8 is a view similar to FIG. 6, illustrating the handle tube being move forwardly relative to the large-diameter cylinder when the adjustment mechanism is in a dual pumping state.
Figure 9:
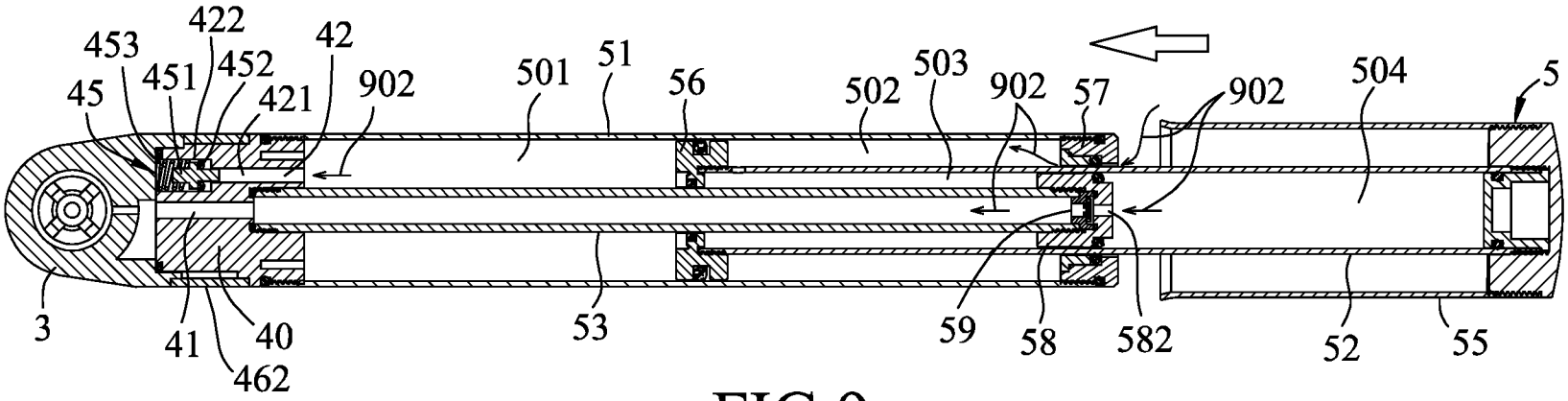
FIG. 9 is a sectional view taken along line C-C in FIG. 1, illustrating the handle tube being move forwardly relative to the large-diameter cylinder when the adjustment mechanism is in the dual pumping state.

Referring back to FIGS. 8 to 10, when the adjustment mechanism 4 is in the dual pumping state, the air exhaust switch 46 seals the exhaust hole 43. As the small-diameter cylinder 52 is pushed toward the adjustment mechanism 4, the first space 501 and the fourth space 504 shrink in volume, the second space 502 and the third space 503 expand in volume, the intake plug 57 is open so that the air from the external environment is sucked into the second space 502 (and into the third space 503 via the through hole 520) along a second airflow pathway 902, and the communication plug 58 is sealed to block air flow between the third space 503 and the fourth space 504. As the fourth space 504 becomes shrunk in volume, the air pressure in the fourth space 504 builds up and becomes higher than that of the connecting tube 53, the rear check valve set 59 would be driven by the air pressure of the fourth space 504 to open, such that the air in the fourth space 504 is guided by the connecting tube 53 to be injected into the mouthpiece 3 for pumping the inflatable object along the second airflow pathway 902. As the exhaust hole 43 is sealed when the adjustment mechanism 4 is in the dual pumping state, the air pressure in the first space 501 builds up, such that, when the air pressure in the first space 501 is higher than that of the inflatable object fluidly communicated to the mouthpiece 3, the air pressure in the first space 501 would trigger the front check valve set 45 to open, thereby allowing the air to be injected through the second pumping hole 42 into the mouthpiece 3 along the second airflow pathway 902 (see FIG. 9).

Figure 11:
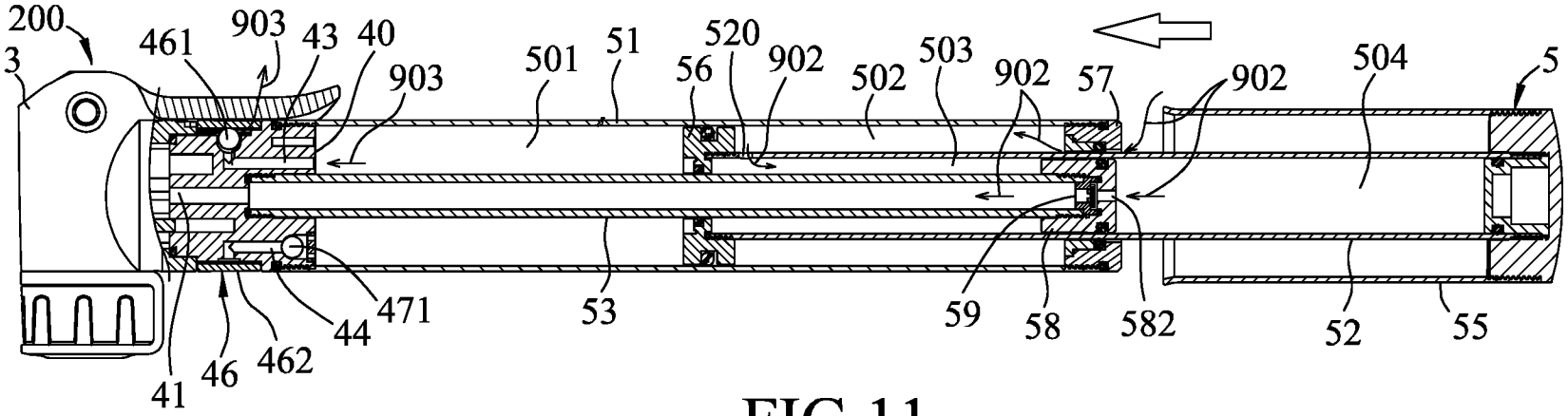
FIG. 11 is a view similar to FIG. 8, illustrating the handle tube being move forwardly relative to the large-diameter cylinder when the adjustment mechanism is in a singular pumping state.
Figure 12:
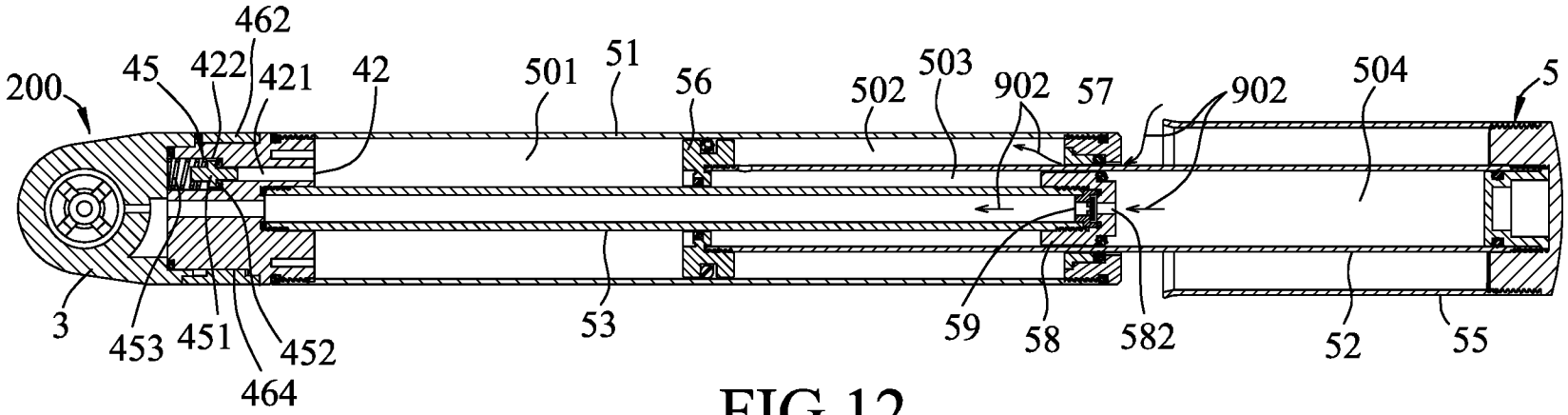
FIG. 12 is a view similar to FIG. 9, illustrating the handle tube being move forwardly relative to the large-diameter cylinder when the adjustment mechanism is in the singular pumping state.

Referring to FIGS. 11 and 12, when the adjustment mechanism is in the single pumping state, since the air exhaust switch 46 is in the open position, the air pressure in the first space 501 would trigger the sealing member 461 to move radially and outwardly, such that the exhaust hole 43 is permitted to release the air in the first space 501 into the external environment along a third airflow pathway 903. As a result, only the air in the fourth space 504 is injected into the mouthpiece 3 sequentially via the rear check valve set 59 and the connecting tube 53 along the second airflow pathway 902.

Overall, by utilizing the singular and dual pumping states of the adjustment mechanism 4, the air pump 200 is operable to pump the air into the inflatable object with different intensity. Specifically, in the dual pumping state, the adjustment mechanism 4 permits the air in both the first space 501 and the fourth space 504 to be simultaneously injected into the inflatable object, which is desirable when the inflatable object is in a low pressure state, such that a large amount of air may be swiftly injected thereto before air pressure in the inflatable object begins to build up to resist the supplied air from the air pump 200. Once the air pressure in the inflatable object reaches above a predetermined pressure state such that it becomes difficult for the small-diameter cylinder 52 to perform the air pumping process, the adjustment mechanism. 4 may be switched to the singular pumping state so that only the air in the fourth space 504 is to be injected into the inflatable object, while the air in the first space 501 is fluidly communicated with the external environment instead and not injected into the inflatable object just to be resisted by the air pressure therefrom. Although less air is being pumped into the inflatable object in the singular pumping state, the air pump 200 is less labor-intensive during this state.

In addition, the design of the adjustment mechanism 4 and the air cylinder mechanism 5 ensures that the user would not injure oneself, as the handle tube 55 is retained in movement in such a way that the hand holding onto either the adjustment mechanism 4 or the large-diameter cylinder 51 would not be in contact therewith during the cyclic air pumping process, and that the small-diameter cylinder 52 would be able to be pushed thoroughly relative to the large-diameter cylinder 51 for maximum pumping efficiency.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An air pump comprising:

a mouthpiece;

an adjustment mechanism fixedly mounted to said mouthpiece, and operable to switch between a singular pumping state and a dual pumping state; and an air cylinder mechanism including a connecting tube that extends axially in a front-rear direction and that has a front end fixedly connected to said adjustment mechanism and in fluid communication with said mouthpiece, a small-diameter cylinder that extends axially and that sleeves around said connecting tube, a large-diameter cylinder that extends axially, that sleeves around said small-diameter cylinder and that has a front end fixedly connected to said adjustment mechanism, an end plug that seals a rear end of said small-diameter cylinder, a unidirectional intake plug that is fixedly mounted to a rear end of said large-diameter cylinder and that sleevedly abuts against an outer surrounding surface of said small-diameter cylinder, a piston that is fixedly mounted to a front end of said small-diameter cylinder and that airtightly abuts against an inner surrounding surface of said large-diameter cylinder and an outer surrounding surface of said connecting tube, said piston and said adjustment mechanism cooperatively defining a first space therebetween, said piston and said intake plug cooperatively defining a second space therebetween, a unidirectional communication plug that is fixedly mounted to a rear end of said connecting tube, that is fluidly communicated to said connecting tube, and that abuts against an inner surrounding surface of said small-diameter cylinder, said communication plug and said piston cooperatively defining a third space therebetween that is in fluid communication with said second space, said communication plug and said end plug cooperatively defining a fourth space therebetween, and a rear check valve set that is mounted between said connecting tube and said communication plug;

wherein, when said small-diameter cylinder is moved away from said adjustment mechanism, air from an external environment is sucked into said first space via said adjustment mechanism, and air in said second space and said third space is pushed to flow into said fourth space via said communication plug;

wherein, when said small-diameter cylinder is moved toward said adjustment mechanism, said intake plug and said rear check valve set are open, such that the air from the external environment is sucked into said second space via said intake plug, and air in said fourth space is injected into said mouthpiece sequentially via said rear check valve set and said connecting tube;

wherein, when said adjustment mechanism is in the singular pumping state, air in said first space is released to the external environment during the movement of said small-diameter cylinder toward said adjustment mechanism; and wherein, when said adjustment mechanism is in the dual pumping state, air in said first space is injected into said mouthpiece during the movement of said small-diameter cylinder toward said adjustment mechanism.

2. The air pump as claimed in claim 1, wherein said air cylinder mechanism further includes a handle tube that is fixedly mounted to said end plug and that is permitted to move relative to said large-diameter cylinder to sleeve therearound.

3. The air pump as claimed in claim 1, wherein:

said adjustment mechanism includes an adjustment seat that is fixedly mounted to said mouthpiece, that is connected to said large-diameter cylinder and said connecting tube, and that has a first pumping hole fluidly communicating said mouthpiece to said connecting tube, a second pumping hole fluidly communicating said mouthpiece to said first space, an exhaust hole fluidly communicating said first space to the external environment, and an intake hole fluidly communicating the external environment to said first space, a front check valve set that is mounted to said adjustment seat and that is permitted to be driven by air pressure of said first space to openably and unidirectionally seal said second pumping hole, an air exhaust switch that is mounted to said adjustment seat, and that is operable to openably seal said exhaust hole, and a unidirectional intake valve set that is mounted to said adjustment seat, and that is permitted to be driven by the air pressure of said first space to seal said intake hole;

when said adjustment mechanism is in the singular pumping state, said air exhaust switch is open so that said exhaust hole is permitted to release the air in said first space into the external environment; and when said adjustment mechanism is in the dual pumping state, said air exhaust switch seals said exhaust hole.

4. The air pump as claimed in claim 3, wherein:

said exhaust hole of said adjustment mechanism has a connecting section that extends axially and that is fluidly communicated to said first space, a small-diameter exhaust section that extends radially and that is fluidly communicated to said connecting section, and a large-diameter exhaust section that is coaxial with said small-diameter exhaust section and that fluidly communicates said small-diameter exhaust section to the external environment and that has a diameter larger than that of said small-diameter exhaust section;

said air exhaust switch of said adjustment mechanism has a sealing member that is mounted in said large-diameter exhaust section and that is permitted to seal said small-diameter exhaust section, and an adjustment member that is mounted to said adjustment seat;

when said adjustment mechanism is in the dual pumping state, said sealing member is pushed by said adjustment member to move radially and inwardly to seal said small-diameter exhaust section; and when said adjustment mechanism is in the singular pumping state, said adjustment member is separated from said sealing member so that said sealing member is permitted to be driven by air pressure in the small-diameter exhaust section to move radially and outwardly.

5. The air pump as claimed in claim 4, wherein said adjustment member of said air exhaust switch of said adjustment mechanism has an annular portion that is operable to rotatably sleeve around said adjustment seat and to cover said exhaust hole, and an abutting portion that protrudes radially from an inner surface of said annular portion and that is driven by said annular portion to removably and radially push said sealing member.

6. The air pump as claimed in claim 3, wherein:

said second pumping hole of said adjustment mechanism has a small-diameter pumping section that extends axially and that is fluidly communicated to said first space, and a large-diameter pumping section that fluidly communicates said small-diameter pumping section to said mouthpiece and that has a diameter larger than that of said small-diameter pumping section;

said front check valve set of said adjustment mechanism includes a check valve body that is mounted in said large-diameter pumping section and that is inserted into said small-diameter pumping section, a valve gasket that sleeves around said check valve body, and a resilient member that is mounted to said large-diameter pumping section and that resiliently biases said check valve body toward said small-diameter pumping section to cooperate with said valve gasket for sealing said small-diameter pumping section.

7. The air pump as claimed in claim 3, wherein:

said intake hole of said adjustment mechanism has an outer connecting section that is fluidly communicated to the external environment, and an inner connecting section that extends axially and fluidly communicates said outer connecting section to said first space in said air cylinder mechanism and that has a diameter larger than that of said outer connecting section;

said intake valve set of said adjustment mechanism includes a valve member that is movably mounted in said inner connecting section and that is permitted to be driven by the air pressure of said first space to seal said outer connecting section, and a blocking member that communicates said inner connecting section to said first space, that is mounted to said adjustment seat, and that retains position of said valve member relative to said inner connecting section.

8. The air pump as claimed in claim 1, wherein:

said communication plug of said air cylinder mechanism includes a plug body that is fixedly mounted to said rear end of said connecting tube and that has an axial hole axially and fluidly communicating said connecting tube and said fourth space of said air cylinder mechanism, and a piston gasket that is axially movable, that sleeves around said plug body and that airtightly abuts against said inner surrounding surface of said small-diameter cylinder;

said plug body has an outer annular groove that indents from an outer surface of said plug body and that is for said piston gasket to sleeve thereto, and a cutoff opening that axially and fluidly communicates said outer annular groove and said fourth space;

when said plug body moves rearwardly relative to said small-diameter cylinder, said piston gasket seals free flow between said cutoff opening and said third space, and when said plug body moves forwardly relative to said small-diameter cylinder, said piston gasket unseals the free flow through said cutoff opening so that said third space is fluidly communicated to said fourth space;

said rear check valve set of said air cylinder mechanism has an annular valve seat that fluidly communicates said connecting tube to said axial hole, and a check valve member that is mounted to said valve seat and that is permitted to be driven by air pressure of said fourth space to openably seal said axial hole.

9. The air pump as claimed in claim 1, wherein:

said intake plug of said air cylinder mechanism includes an end block that is fixedly mounted to said rear end of said large-diameter cylinder and that sleeves around said small-diameter cylinder, and a plug gasket that is mounted to an inner surface of said end block and that airtightly abuts against said small-diameter cylinder;

said inner surface of said end block is indented with an inner annular groove that is for said plug gasket to be movably mounted thereto, and has an intake pathway that axially and fluidly communicates said inner annular groove to the external environment; and when said intake plug moves forwardly relative to said small-diameter cylinder, said plug gasket seals said intake pathway, and when said intake plug moves rearwardly relative to said small-diameter cylinder, said plug gasket unseals said intake pathway so that said second space is fluidly communicated to said external environment via said inner annular groove and said intake pathway.

* * * * *